United States Patent [19]

Bramlette et al.

[11] Patent Number: 4,805,318

[45] Date of Patent: Feb. 21, 1989

[54] ACOUSTICALLY ENHANCED HEAT EXCHANGE AND DRYING APPARATUS

[75] Inventors: T. Tazwell Bramlette, Livermore; Jay O. Keller, Oakland, both of Calif.

[73] Assignee: The United States of America as represented by the United States Department of Energy, Washington, D.C.

[21] Appl. No.: 71,953

[22] Filed: Jul. 10, 1987

[51] Int. Cl.[4] ..... F26B 17/00

[52] U.S. Cl. ..... 34/57 A; 34/10; 431/1; 432/25

[58] Field of Search ..... 432/58, 25; 34/57 A, 34/10; 431/1

[56] References Cited

U.S. PATENT DOCUMENTS

| | | | |
|---|---|---|---|
| 3,584,849 | 6/1971 | Cremer et al. | 263/28 |
| 3,618,655 | 11/1971 | Lockwood | 159/4 E |
| 4,070,765 | 1/1978 | Hovmand et al. | 34/10 |
| 4,260,361 | 4/1981 | Huber | 431/1 |
| 4,329,141 | 5/1982 | Habermehl et al. | 432/17 |
| 4,334,366 | 6/1982 | Lockwood | 34/17 |
| 4,395,830 | 8/1983 | Lockwood | 34/10 |
| 4,417,868 | 11/1983 | Putnam | 431/1 |
| 4,477,246 | 10/1984 | Hisaoka et al. | 431/114 |
| 4,484,885 | 11/1984 | Machii et al. | 431/1 |
| 4,529,377 | 7/1985 | Zinn et al. | 432/58 |
| 4,701,126 | 10/1987 | Gray et al. | 431/1 X |
| 4,708,635 | 11/1987 | Visitwanath | 431/1 |

OTHER PUBLICATIONS

Perry, R. H. & Chilton, C. H., *Chemical Engineers Handbook*, Fifth Edition, McGraw-Hill Book Co., New York, NY, 1973, pp. 20-36.

Belding, J. A. & Burnett, W. M., "From Oil & Gas to Alternate Fuels: The Transition in Conversion Equipment", *Energy Conversion*, vol. 17, No. 2/3, Pergammon Press, 1977, pp. 57-65.

Lockwood, R. M., "Guidelines for Design of Pulse Combustion Devices, Particularly Valveless Pulse Combustors", Proceedings of Symposium on Pulse-Combustion Applications, Atlanta, GA, Mar. 1982, pp. 14-1 to 14-13.

Severyanin, V. S., "Application of Pulsating Combustion in Industrial Installations", Proceedings vol. I: Symposium on Pulse-Combustion Applications, GRI--82/0009.2, Atlanta, GA, Mar. 1982, pp. 7-1 to 7-23.

Zinn, B. T. et al., "Pulsating Combustion of Coal in a Rijke Type Combustor", Proceedings of Nineteenth Symposium (International) on Combustion, The Combustion Institute, 1982, pp. 1197-1203.

Bramlette, T. T., "The ECUT Pulse Combustion Research Program-A Milestone Report", SAND 86-8004, Sandia National Laboratories, Livermore, California, Mar. 1986.

Bramlette, T. T. and Keller, J. O., "Theoretical & Experimental Investigation of a New Pulse Combustor", SAND 86-8050, Sandia National Laboratories, Livermore, California, Jan. 1987.

*Primary Examiner*—Edward G. Favors

*Attorney, Agent, or Firm*—Anne D. Daniel; James H. Chafin; Judson R. Hightower

[57] ABSTRACT

A heat transfer apparatus includes a first chamber having a first heat transfer gas inlet, a second heat transfer gas inlet, and an outlet. A first heat transfer gas source provides a first gas flow to the first chamber through the first heat transfer gas inlet. A second gas flow through a second chamber connected to the side of the first chamber, generates acoustic waves which bring about acoustical coupling of the first and second gases in the acoustically augmented first chamber. The first chamber may also include a material inlet for receiving material to be dried, in which case the gas outlet serves as a dried material and gas outlet.

13 Claims, 2 Drawing Sheets

$D_5$
13
DECOUPLING CHAMBER 2
28
DRIED PRODUCT TO CLEANUP AND COLLECTION SUBSYSTEMS
20
$D_1$
10
12a
12
SECONDARY COMBUSTION SOURCE
$L_2$
$L_1$
30
24
25
16
AIR
$D_6$
DECOUPLING CHAMBER 3
FUEL
$D_2$
MATERIAL TO BE DRIED
$L_3$
11
18
$L_4$
14
26
MAIN COMBUSTION SOURCE
AIR + FUEL
DECOUPLING CHAMBER 1
22
$D_4$

ACOUSTICALLY ENHANCED HEAT EXCHANGE AND DRYING APPARATUS

The U.S. Government has rights in this invention pursuant to Contract No. DE-AC04-76DP00789 between the United States Department of Energy and AT&T Technologies, Inc.

TECHNICAL FIELD

The present invention relates to the field of heat exchangers and to the field of drying particulate materials, and more particularly to heat transfer and drying particulate materials with the aid of acoustic energy.

BACKGROUND OF THE INVENTION

A significant amount of energy is used in this country to remove moisture from a wide variety of products. In many drying techniques, a fuel is combusted and the heat from the combustion is used to dry the wet materials. Nearly one quad (which is defined as $10^{15}$ B.T.U.) of energy was consumed in 1974 for drying, representing more than 1% of the energy consumption for that year. See "Analysis of the Economic Potential of Solar Thermal Energy to Provide Industrial Process Heat," COO/2829-1, 1, Intertechnology Corporation, Warrenton, VA, February, 1977.

The efficiency of a drying process depends on the specific application. However, efficiency values as low as 20–30% are common. See Perry, R. H., and Chilton, C.H., "Chemical Engineers Handbook," Fifth Edition, 20–36, McGraw-Hill Book Co., New York, NY, 1973 and Belding, J.A., and Burnett, W.M., "From Oil and Gas to Alternate Fuels: the Transition in Conversion Equipment", Energy Consumption, 17, No. 2/3, Pergamon Press, 1977.

Fuel consumption and energy considerations are important not only in drying apparatus but are important also in heat exchange apparatus generally. It is a desirable objective to provide an energy exchanging apparatus which brings about effective and efficient heat transfer from a combustion source to the walls of a heat exchanger.

Aside from the fuel consumption and energy considerations, there are also strong economic incentives to increase the efficient use of drying systems, i.e., to increase the throughput of material by more rapid drying techniques.

Drying systems based upon pulse combustors have been built in the past. These systems have exhibited both high efficiency and improved drying. See: Lockwood, R.M., "Guidelines for Design of Pulse Combustion Devices, Particularly Valveless Pulse Combustors," in Proceedings of Symposium on Pulse-Combustion Applications, 14–1 to 14–24, Atlanta, GA March 1982; Lockwood, R.M., "Sonic Energy Perforated Drum for Rotary Dryers," U.S. Pat. No. 4,334,366, June 15, 1982; Lockwood, R.M., "Pulse Combustion Fluidized Dryer," U.S. Pat. No. 4,395,830, ; Aug. 2, 1983; Severyanin, V.S., "Application of Pulsating Combustion in Industrial Installations" in Proceedings of Symposium on "Pulse-Combustion Applications," 7-1 to 7-24, Atlanta, GA, March, 1982; and "Pulse Combustion Drying," Sonodyne Industries, Portland, OR. The flow field oscillations characteristic of pulse combustors are responsible for these improvements. However, because these systems use valveless pulse combustors, noise is a severe problem.

Drying apparatus in the prior art enhance heat transfer by using flow oscillations in the drying gas. Zinn et al U.S. Pat. No. 4,529,377, for example, shows a conventional Rijke tube coupled with a drying column. The boundary condition which must exist at the junction of the two columns of FIG. 6*b* of the Zinn et al patent is one of atmospheric pressure. This condition is necessary to ensure the operation of the lower Rijke tube, which is the combustion source, as well as the operation of the upper Rijke tube, which is where the drying takes place. Thus with the Zinn et al device, drying takes place effectively at only a limited location in the apparatus. It would be desirable, however, if effective drying would take place in a large region in an acoustically augmented drying chamber.

The combustion which occurs in the lower Rijke tube of FIG. 6*b* of the Zinn et al patent varies as a function of time which is a necessary condition to establish stable oscillations in that apparatus. It would be desirable for the combustion processes providing hot gases to an acoustical drying apparatus to be steady processes.

There are configuration constraints associated with the geometry of FIG. 6*b* of the Zinn et al patent. The combustion Rijke tube must be below the drying Rijke tube, which may lead to actual systems of excessive height. It would be desirable to have an acoustical drying apparatus in which the configuration of a combustion source with respect to the acoustically augmented drying chamber not be severely constrained to operate efficiently.

The problem of noise reduction is recognized in U. S. Pat. No. 4,417,868 of Putnam in which noise reduction is achieved by coupling more than one pulse combustor with an inlet plenum which has a series of baffles to increase the acoustical path length. The various combustors operate out of phase, which tends to reduce noise. The main objective of the Putnam invention is to reduce the physical size of the plenum. It would be desirable to achieve noise reduction without such a complex drying apparatus. Habermehl et al., U. S. Pat. No. 4,329,141 achieves a pulsating flow by mechanically modulating the flow through the drying system with, for example, a rotating throttling valve. Inherent in this approach is a flow field which has a time varying velocity, but one which does not reverse direction. It would be desirable to have a flow field in an acoustically augmented drying chamber which would exhibit flow reversal. A reversing flow field would have significantly higher heat and mass transfer than one which does not reverse.

SUMMARY OF THE INVENTION

Accordingly, it is a primary object of the present invention to provide a valveless acoustically augmented heat transfer and drying apparatus which produces low noise when in use.

Another object of the invention is to provide an acoustically augmented heat transfer and drying apparatus in which effective drying takes place in a large region in the acoustically augmented drying chamber.

Another object of the invention is to provide an acoustically augmented heat transfer apparatus in which the heat transfer from the energy source to the wall of the heat exchanger is facilitated and made more efficient.

Another object is to provide an acoustically augmented heat transfer and drying apparatus in which the combustion process is a steady process without moving mechanical parts.

Still another object of the invention is to provide an acoustically augmented heat transfer and drying apparatus in which the geometrical design configuration of a combustion source with respect to the acoustically augmented drying chamber is not substantially constrained in order to provide a system which operates with desired thermal efficiency.

An additional object of the invention is to provide an acoustically augmented heat transfer and drying apparatus in which noise reduction is achieved without complexity.

Yet another object of the invention is to provide an acoustical drying apparatus having a velocity field in an acoustically augmented drying chamber which exhibits flow reversal.

Another object of the invention is to provide an acoustically coupled heat transfer and drying apparatus in which a first heat transfer gas flow is relatively large and is acoustically modulated by a relatively small second heat exchange gas flow.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes on the present invention as described herein, an improved heat transfer apparatus and method are provided. The improved heat transfer apparatus is comprised of a first chamber, also referred to as an acoustically augmented heat transfer chamber, having a longitudinal axis, first and second ends, a first heat transfer gas inlet, a second heat transfer gas inlet, a gas outlet, a first heat transfer gas source, a second heat transfer gas source, and a means for generating acoustic waves causing acoustic coupling in the first chamber. The first heat transfer gas source provides a first heat transfer gas to the first chamber through the first heat transfer gas inlet. The second heat transfer gas source provides a second heat transfer gas to the first chamber and through the second heat transfer gas inlet. The means for generating acoustic waves includes a second chamber, also known as a drying gas chamber, extending longitudinally from the first chamber at the second gas inlet, in which the second heat transfer gas source is located. The acoustic waves cause acoustic coupling of the second heat transfer gas to the first heat transfer gas in the first chamber.

Preferably, the first heat transfer gas source is a first combustion source, and the second heat transfer gas source is a second combustion source.

Preferably, the second chamber and the second combustion source have no pulsating valves. The second combustion source inside the second chamber brings about acoustic coupling of the gases in the first chamber because acoustic oscillations in the second heat transfer gas are brought about by fluid mechanical phenomena resulting from the configuration of the second chamber and the second combustion source. The acoustic frequency oscillations enhance heat conduction and mass flow within the first acoustically augmented heat transfer chamber.

Preferably, the first heat transfer gas source includes a first decoupling chamber, the gas outlet includes a second decoupling chamber, and the second heat transfer gas source includes a third decoupling chamber. In these decoupling chambers, the oscillations of the first chamber are brought into communication with atmospheric boundary conditions.

The strength of the acoustic coupling in the first chamber is dependent on the following geometrical and system parameters: L1, the distance between the first heat transfer gas inlet and the gas outlet; L2, the length of the second chamber; D1, the diameter of the first chamber; D2, the diameter of the second chamber; the ratio L1/Dl; the ratio L2/D2; L3, the distance between the first heat transfer gas inlet and the second heat transfer gas inlet; the location of the combustion source inside the second chamber relative to the second heat transfer gas inlet; and the amount of energy introduced in the second combustion source.

In embodiments that were tested, the frequency at which the acoustically augmented heat transfer chamber operates is in the range of 170–210 Hz. An embodiment of the invention has been built in which the frequency at which the acoustically augmented heat transfer chamber operates is approximately 182 Hz. However, the operating frequency ranges are limited only by the overall design characteristics of a particular apparatus.

Preferably, the energy content of the second heat transfer gas is in the range of 1–2% of the energy content of the first heat transfer gas.

In a further aspect of the invention, in accordance with its objects and purposes, the acoustically augmented heat transfer chamber further includes an inlet for admitting material to be dried into the acoustically augmented heat transfer chamber. The material to be dried can be particulate solid or liquid droplet material.

In accordance with another aspect of the invention, a method for facilitating heat transfer to the wall of an acoustic chamber type heat exchanger comprises applying a first supply of heated gas to the chamber while concurrently applying to the chamber a second supply of heated gas. The second supply of heated gas oscillates at an acoustic frequency and couples with the first supply of heated gas inside the chamber to bring about resonant pressure waves which result in velocity oscillations in the gas inside the chamber. The acoustic gas oscillations inside the chamber facilitate conduction of energy residing in the gases to the walls of the chamber. The energy brought to the walls of the chamber by the acoustic oscillations of the contents of the chamber is conducted through the walls of the chamber to the medium outside the chamber that receives the exchanged energy.

Still other objects of the present invention will become readily apparent to those skilled in this art from the following description wherein there is shown and described a preferred embodiment of this invention, simply by way of illustration. The invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE INVENTION

Figure 1:
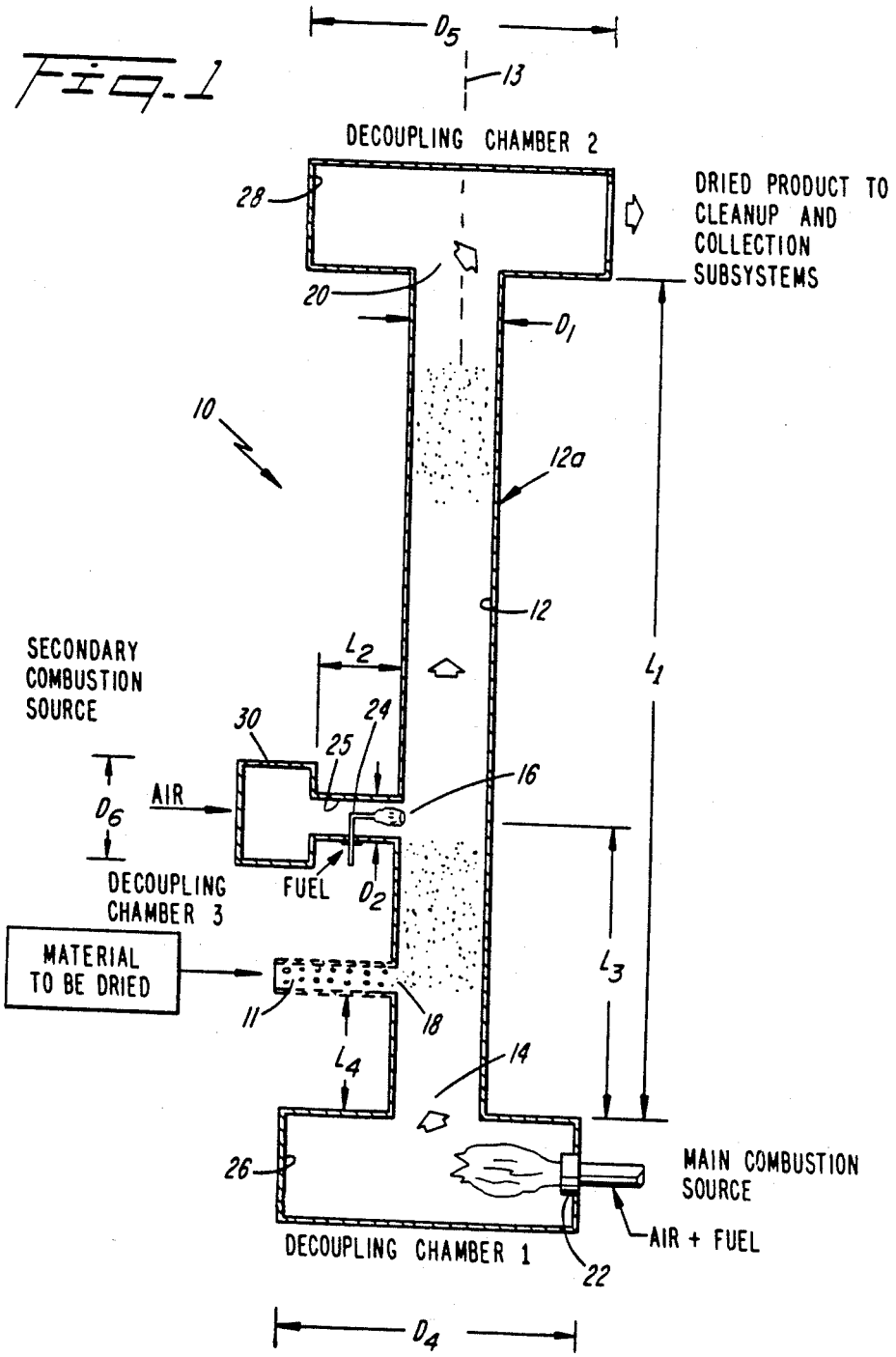
FIG. 1 is a schematic diagram of an embodiment of the invention.

Reference is made to FIG. 1 showing a heat transfer apparatus 10 having an acoustically augmented heat transfer chamber 12 for drying particulate material 11 contained therein. The heat transfer chamber 12 includes a first heat transfer gas inlet 14, a second heat transfer gas inlet 16, material inlet 18, and a gas outlet 20 which also serves as a dried material and gas outlet.

A first heat transfer gas source 22 provides a first drying gas to the acoustically augmented heat transfer chamber 12 through the first heat transfer gas inlet 14. As illustrated, the main source of hot gases for drying, source 22, is located in first decoupling chamber 26. The first decoupling chamber 26 is merely a large volume to provide a constant pressure boundary condition at the base of vertical tube 12*a* of length L1 and diameter D1. A second decoupling chamber 28 and third decoupling chamber 30 serve the same function, with a second heat transfer gas source 24 located in a second drying gas chamber 25 connected at one end to vertical tube 12a at L3.

Although shown for illustration in the lower half of the vertical tube 12*a*, the present invention works equally well when inlet 16 the second heat transfer gas source 24 in chamber 25 are in the upper half of the tube 12*a*. This characteristic is important because it demonstrates that the present invention is not a variation of a Rijke tube, which operates only when combustion occurs at a location $L\frac{1}{4}$ from its decoupling chamber. See: Zinn, B. T., et al., "Pulsating Combustion of Coal in a Rijke Type Combustor," in Proceedings of Nineteenth Symposium (International) on Combustion, 1197–1203, The Combustion Institute, 1982.

The second heat transfer gas source 24, located in a second drying gas chamber 25, provides a second drying gas to the acoustically augmented heat transfer chamber 12 through the second heat transfer gas inlet 16. The second drying gas also serves to generate acoustic waves which bring about acoustical coupling with the gases in the acoustically augmented heat transfer chamber 12. The second drying gas itself oscillates at an acoustic frequency due to fluid mechanical motion in the gas in the second drying gas chamber 25. Because the second drying gas oscillates, the heat transfer from the second drying gas to the first drying gas in the acoustically augmented heat transfer chamber 12 also oscillates. In this way, the oscillations of the second heat transfer gas are coupled to the first heat transfer gas in the acoustically augmented heat transfer chamber 12. As shown in FIG. 1, the second heat transfer gas source 24 provides the second drying gas to the acoustically augmented heat transfer chamber 12 at substantially a right angle to the longitudinal axis of the acoustically augmented heat transfer chamber 12. The position of the second heat transfer gas source 24 within the second drying gas chamber 25, relative to inlet 16, and the length of the second drying gas chamber 25 are critical for bringing about acoustic oscillations.

The energy content of the second heat transfer gas is relatively small compared to the energy content of the first heat transfer gas. Preferably, the energy content of the second heat transfer gas is only 1–2% of the content of the first heat transfer gas. Therefore, only a small secondary energy source can be used to modulate a large heat transfer energy input to bring about substantially improved heat transfer from the first heat transfer gas.

In FIG. 1, the distance between the first inlet 14 to chamber 12 and the gas outlet 20 from chamber 12 is designated L1, the length of the second chamber 25 is designated L2, and the distance between the first inlet 14 and the second inlet 16 is designated L3. The distance between the first inlet 14 and the material inlet 18 is designated L4. The diameter of chamber 12 is designated D1, and the diameter of the second chamber 25 is designated D2.

The strength of the acoustic coupling in the acoustically augmented heat transfer chamber 12 is dependent upon L1, L2, D1, D2, the ratio L1/D1; the ratio L2/D2; L3, the location of the combustion source inside the second chamber relative to the second heat transfer gas inlet, and the amount of energy released by the second combustion source.

Of course, with an embodiment of the invention that does not have a material inlet 18 there would be no distance L4. This occurs when the invention is used as a heat exchanger, rather than as a particulate material drier.

Preferably, the first heat transfer gas source 22 further includes a first decoupling chamber 26 in communication with the acoustically augmented heat transfer chamber 12. The dried material and gas outlet 20 includes a second decoupling chamber 28. The second heat transfer gas source 24 further includes a third decoupling chamber 30 in communication with the acoustically augmented heat transfer chamber 12. Each of the decoupling chambers 26, 28, and 30 serves to decouple resonant pressure oscillations and bring the operating pressures back to atmospheric or constant pressure boundary conditions.

Reference is made to the following publication in which a theoretical discussion is provided, wherein the theory is derived from working embodiments of the invention. Theoretical and Experimental Investigation of a New Pulse Combustor, by T. Tazwell Bramlette and J. O. Keller, SAND86-8050, Sandia National Laboratories, Livermore, Calif., December 1986.

In this regard, a specific embodiment of the invention has been built and tested extensively having the following parameters:

L1=1 meter (m)
L2=10 centimeters (cm)
L3=0.5 m
L4=0.25 m
D1=5 cm
D2=2.5 cm.

Further tests and theoretical considerations indicate that L1 can be a wide range of satisfactory lengths depending on the desired application. With modification of the apparatus tested, the range of L1 can include 0.5–10 meters.

In general, L2 is a relatively critical dimension. By modifying the embodiment of the invention that has been tested, it has been discerned that L2 can be in the range of 10–15 cm.

With the embodiment of the invention that has been tested, it has been determined that the length L3 is not critical. Suitable lengths for L3 in modified versions of the apparatus tested are in the range of 0.25–0.75 meter. More generally, L3 has been determined to be suitable in the range of 0.25–0.75 times the length of L1.

In general, the length of L4 is not critical. It can be virtually any length up to the length of L1.

By modifying the embodiment of the invention referred to above, diameter D1 can be in the range of 5 cm to 0.5 m. In general, the length of D1 is not too critical to the satisfactory operation of the invention.

By modifying the embodiment of the invention referred to above, diameter D2 has been determined to be satisfactory in the range of 2–3 cm.

In the embodiment of the invention referred to above, no decoupling chambers were employed. Atmospheric air at atmospheric pressure served as boundaries for the acoustic decoupling. However, decoupling chambers may be employed with other embodiments of the invention .

Diameters D4, D5, and D6 of the decoupling chambers 26, 28, 30 can be three to four times the diameters D1, D1, and D2 of inlet 14, outlet 20, and inlet 16 respectively, with which they are joined.

Both the first drying gas source 22 and the second drying gas source 24 can be continuous combustion sources. No valves need be present to bring about oscillations in the gases in the acoustically augmented heat transfer chamber. It is the fluid mechanical motion of the second drying gas, the configuration of the second drying gas chamber 25 and the location of the second drying gas source 24 in the second drying gas chamber 25 that brings about acoustical oscillations in the second drying gas, and these acoustic oscillations are coupled to the first drying gas in the acoustically augmented heat transfer chamber 12.

With the embodiment of the invention tested and described above, the acoustic frequency was measured to be approximately 182 Hz. This corresponds to a cycle time of 1/182 or approximately 5.5 milliseconds per cycle.

The coupling frequency of about 180 Hz of the valveless acoustic coupling apparatus of the invention has an advantage over other drying or other heat transfer devices having other operating frequencies, such as devices powered by pulse combustors having mechanical valves for bringing about pulsations. Valved pulse combustors have coupling frequencies in the range of 50 Hz. It is easier to muffle noise at 180 Hz than noise at 50 Hz. Consequently, using an acoustically coupled drying device made in accordance with the invention, it is easier to muffle the apparatus and obtain a relatively quiet running drying or other heat transfer apparatus.

Figure 2:
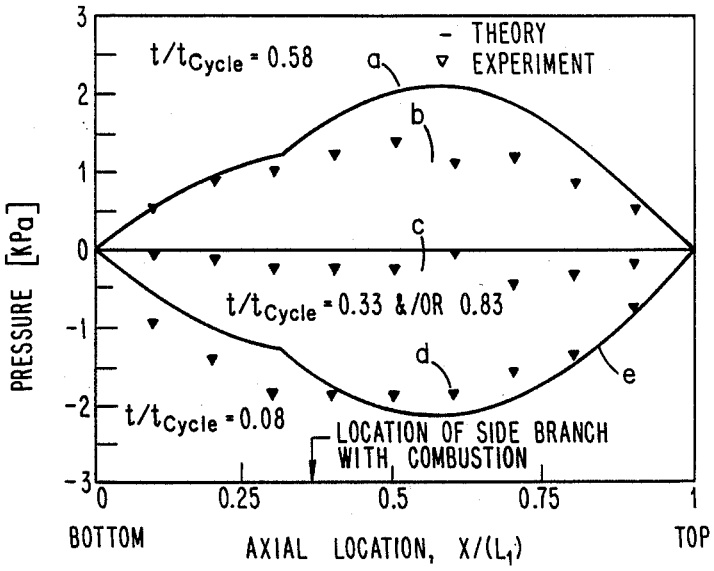
FIG. 2 is a depiction of five graphs showing experimental and theoretical pressure variation inside the acoustically augmented heat transfer chamber versus axial location along the acoustically augmented heat transfer chamber.

FIG. 2 shows five graphs on the same axes wherein the abscissa is a vertical axial location along the length of the acoustically augmented heat transfer chamber 12, and the ordinate is a measure of pressure in the acoustically augmented heat transfer chamber 12. This figure presents the pressure amplitude in the vertical section for three different times during a cycle: at the maximum and minimum amplitudes, and at approximately zero amplitude. Graph **2*a* is a theoretical trace of axial location versus pressure and shows the theoretical pressure variations inside the acoustically augmented heat transfer chamber 12 for the system actually operating at 182 Hz (theoretically operating at 204 Hz) and having a cycle time of approximately 5.5 milliseconds. For Graph 2*a*, the time at which measurements were theoretically made was at t/t(cycle)=0.58. Graph 2*b*** shows actual measurements that were made at t/t(cycle)=0.58.

Graph **2*c* shows an actual measure of pressure variation versus vertical axial location along the acoustically augmented heat transfer chamber 12** for t/t(cycle)=0.33 and/or 0.83. Pressure variations at these times are at a minimum.

Graph **2*e* is a theoretical trace of axial location versus pressure and shows the theoretical pressure variations inside the acoustically augmented heat transfer chamber 12 measured at a time where t/t(cycle)=0.08. Graph 2*d*** shows actual measurements that were made at t/t(cycle)=0.08.

Graphs **2*a*, 2*b*, 2*d*, and 2*e* make it clear that the apparatus made in accordance with the invention provides significant acoustical pressure variation in the acoustically augmented heat transfer chamber 12 along a substantial portion of the acoustically augmented heat transfer chamber 12** from approximately 0.25–0.75 of its length.

The agreement between theory and experiment is quite satisfactory. An important point is that the disagreement between theory and experiment for both pressure amplitude and frequency is in the direction one would expect for an analysis that neglected viscous losses.

Figure 3:
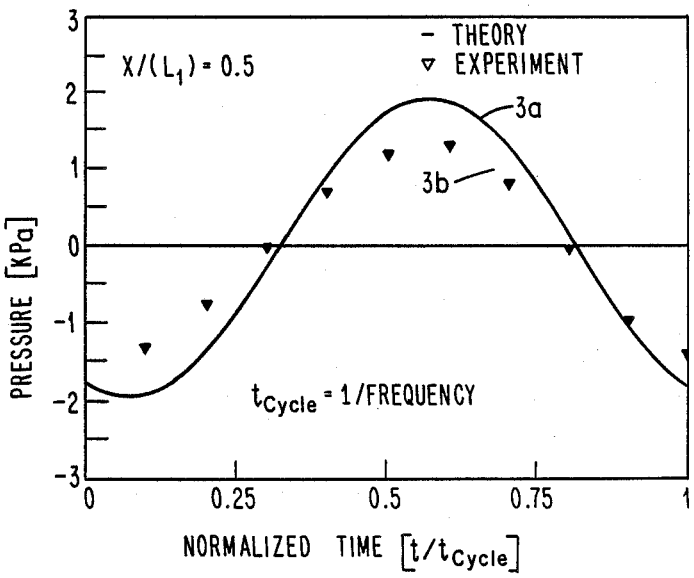
FIG. 3 is a depiction of two graphs showing experimental and theoretical pressure variation inside the acoustically augmented heat transfer chamber versus the time at which pressure variations are taken.

FIG. 3 shows two graphs on the same axes where the abscissa is the time at which pressure measurements are made at a point midway along the acoustically augmented heat transfer chamber 12. The measurement time is expressed as a fraction of the cycle time for the acoustic frequency. The theoretical acoustic frequency is 204 Hz. The actual acoustic frequency is 182 Hz. The ordinate is a measure of pressure in the acoustically augmented heat transfer chamber 12 at the midway point along the acoustically augmented heat transfer chamber 12. The pressure scale has a zero value midway on the scale and positive values above the zero, and negative values below the zero. Graph **3*a* is a theoretical trace, and graph 3*b* shows actual measurements. Each point along the length of the acoustical chamber 12 alternately experiences positive and negative pressure values. The alternating positive and negative pressures cause the gases within the chamber 12 to alternately flow up and down. Thereby, a reversal of the direction of flow of the gases within the chamber 12** are obtained.

Graphs **3*a* and 3*b* make it clear that significant pressure variations are in progress inside the acoustically augmented heat transfer chamber 12** during nearly the entire cycle of each cycle of the acoustical oscillations.

Numerous benefits have been described by employing the concepts of the invention. A brief review follows as to some of these benefits.

With the present invention an acoustically augmented heat transfer and drying apparatus is provided which does not have pulsating valves and produces low noise when in use. With the invention, an acoustically augmented heat transfer and drying apparatus is provided in which effective drying takes place in a large region in the acoustically augmented drying chamber, i.e., in a region from 0.25–0.75 the length of the chamber. Also, with the invention an acoustically augmented heat transfer apparatus is provided in which the heat transfer from the energy source to the wall of the heat exchanger is facilitated and made more efficient.

An additional benefit of employing the invention is that an acoustically augmented heat transfer and drying apparatus is provided in which the combustion process is a continuous process without pulsating mechanical structures such as pulsating valves. Still another benefit of the invention is the provision of an acoustically augmented heat transfer and drying apparatus in which the configuration of a combustion source with respect to the acoustically augmented drying chamber is not severely constrained to operate efficiently; that is, large units of the invention can be built without being excessively expensive or technologically impractical.

An additional benefit of the present invention is that an acoustically augmented heat transfer and drying apparatus is provided in which noise reduction is achieved without a complex apparatus. Yet another benefit of the present invention is the provision of an acoustical drying apparatus having a flow field in an acoustically augmented drying chamber which exhibits flow reversal. This is achieved because at any point along the length of the acoustically augmented heat transfer and drying chamber, the gage pressure varies alternately between positive and negative values.

With the invention an acoustically coupled heat transfer and drying apparatus is provided in which a first heat transfer gas flow has a relatively large energy content and is acoustically modulated by a relatively small second heat transfer gas flow having an energy content of only 1–2% of the larger first heat transfer gas flow.

The drying system of the present invention is based upon an entirely new concept that avoids the usual noise problems and offers a significant retrofit potential for existing drying systems.

The foregoing description of the invention has been presented for purposes of illustration and description. It is not intended to be exhaustive or to limit the invention to the precise form disclosed. Obvious modifications or variations are possible in light of the above teachings. For example, large scale embodiments of the invention can be built. Also, a wide variety of fuel and combustion sources can be used for supplying the heat transfer gases. Both secondary combustion sources and main combustion sources used with the invention can be pulsating combustion sources. Because of the simplicity of the apparatus of the invention, there is significant potential for retrofit into existing drying systems. While heat transfer and drying have been chosen as the applications of the present invention, the configuration lends itself to other applications—for example, chemical processes. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A heat transfer apparatus, comprising:

a first chamber, having a longitudinal axis and first and second ends, and including first heat transfer gas inlet means, second heat transfer gas inlet means located intermediate to said first and second ends, and gas outlet means, a first heat transfer gas source for providing a first heat transfer gas to said first chamber through said first heat transfer gas inlet means, a second heat transfer gas source for providing a second heat transfer gas to said first chamber through said second heat transfer gas inlet means, and means for generating acoustic waves for causing acoustical coupling of said second heat transfer gas to said first heat transfer gas in said first chamber, said means comprising a second chamber extending longitudinally from said first chamber at said second heat transfer gas inlet means, said second heat transfer gas source being located in said second chamber.

2. An apparatus as defined in claim 1 wherein said first heat transfer gas source comprises a first combustion source.

3. An apparatus as defined in claim 1 wherein said second heat transfer gas source comprises a second combustion source.

4. An apparatus as defined in claim 3 wherein said second combustion source comprises valveless means for bringing about acoustic coupling with said first chamber.

5. An apparatus as defined in claim 1 wherein said first heat transfer gas source further comprises a first decoupling chamber.

6. An apparatus as defined in claim 1 wherein said gas outlet means comprises a second decoupling chamber.

7. An apparatus as defined in claim 1 wherein said second heat transfer gas source further comprises a third decoupling chamber.

8. An apparatus as defined in claim 1 wherein said first chamber further comprises material inlet means for admitting material to be dried into said first chamber.

9. An apparatus as defined in claim 1 wherein the energy content of the second heat transfer gas is in the range of 1–2% of the energy content of the first heat transfer gas.

10. An apparatus as defined in claim 1 wherein said second heat transfer gas source provides said second heat transfer gas to said first chamber at substantially a right angle to said longitudinal axis of said first chamber.

11. A heat transfer apparatus, comprising:

a first chamber, having a longitudinal axis and first and second ends, and including first heat transfer gas inlet means, second heat transfer gas inlet means located intermediate to said first and second ends, and gas outlet means, a first heat transfer gas source for providing a first heat transfer gas to said first chamber through said first heat transfer gas inlet means, a second heat transfer gas source for providing a second heat transfer gas to said first chamber through said second heat transfer gas inlet means, and means for generating acoustic waves for causing acoustical coupling of said second heat transfer gas to said first heat transfer gas in said first chamber, said means comprising a second chamber extending longitudinally from said first chamber at said second heat transfer gas inlet means, said second heat transfer gas source being located in said second chamber, wherein said second heat transfer gas source provides said second heat transfer gas to said first chamber at substantially a right angle to said longitudinal axis of said first chamber, and whereby, acoustical coupling in said first chamber is dependent upon L1, L2, D1, D2, the ratio L1/D1, the ratio L2/D2, L3, the location of said second heat transfer gas source in said second chamber relative to said second heat transfer gas inlet means, and the amount of energy introduced from said second heat transfer gas, wherein:

L1 is the distance between said first inlet means and said gas outlet means;

L2 is the length of said second chamber;

L3 is the distance between said first heat transfer gas inlet means and said second heat transfer gas inlet means;

D1 is the diameter of said first chamber; and

D2 is the diameter of said second chamber.

12. A heat transfer apparatus, comprising:

a first chamber, having a longitudinal axis and first and second ends, and including first heat transfer gas inlet means, second heat transfer gas inlet means located intermediate to said first and second ends, and gas outlet means, a first heat transfer gas source for providing a first heat transfer gas to said first chamber through said first heat transfer gas inlet means, a second heat transfer gas source for providing a second heat transfer gas to said first chamber through said second heat transfer gas inlet means, and means for generating acoustic waves for causing acoustical coupling of said second heat transfer gas to said first heat transfer gas in said first chamber, said means comprising a second chamber extending longitudinally from said first chamber at said second heat transfer gas inlet means, said second heat transfer gas source being located in said second chamber, wherein said first heat transfer gas source further comprises a first decoupling chamber, said gas outlet means further comprises a second decoupling chamber, and second heat transfer gas source further comprises a third decoupling chamber.

13. A method of heat exchange, utilizing a first chamber having a longitudinal axis and first and second ends and including a first gas inlet means, a second gas inlet means located intermediate to said first and second ends, and a gas outlet means, and a second chamber extending longitudinally from said first chamber at second gas inlet means and, and comprising the steps of:

providing said first chamber with a first supply of heated gas;

providing said first chamber with a second supply of heated gas through said second inlet means, said second supply of gas being located in said second chamber;

oscillating said second supply of heated gas at an acoustic frequency;

coupling said second supply of heated gas with said first supply of heated gas inside said first chamber to bring about acoustic gas oscillations inside said first chamber and thereby facilitate heat conduction to the walls of said first chamber; and conducting heat exchange at the walls of said first chamber.

* * * * *